US006652621B1

(12) United States Patent
Oishibashi et al.

(10) Patent No.: US 6,652,621 B1
(45) Date of Patent: Nov. 25, 2003

(54) PRODUCTION METHOD FOR MAGNESIUM ALLOY MEMBER

(76) Inventors: Hiroji Oishibashi, 5-6, Showamachi 1-chome, Katsuyama-shi, Fukui (JP); Yutaka Matsuda, 5-33 Miyayama-cho 1-chome, Toyonaka-shi, Osaka (JP)

( * ) Notice: Subject to any disclaimer, the term of this patent is extended or adjusted under 35 U.S.C. 154(b) by 0 days.

(21) Appl. No.: 10/049,541

(22) PCT Filed: May 11, 2000

(86) PCT No.: PCT/JP00/03035

§ 371 (c)(1),
(2), (4) Date: Nov. 13, 2001

(87) PCT Pub. No.: WO00/70114

PCT Pub. Date: Nov. 23, 2000

(30) Foreign Application Priority Data

May 14, 1999 (JP) ..... 11-134184

(51) Int. Cl.[7] ..... C22B 26/22
(52) U.S. Cl. ..... 75/604; 148/420; 420/407
(58) Field of Search ..... 75/604; 148/420; 420/407

(56) References Cited

U.S. PATENT DOCUMENTS 2,448,993 A * 9/1948 Mahoney et al. ..... 420/407
4,056,874 A * 11/1977 Kalnin ..... 148/420
5,221,376 A * 6/1993 Masumoto et al. ..... 148/403
5,501,748 A * 3/1996 Gjestland et al. ..... 148/420

FOREIGN PATENT DOCUMENTS

JP 1-247539 10/1989
JP 7-51827 2/1995

* cited by examiner

*Primary Examiner*—Roy King
*Assistant Examiner*—Andrew Wessman
(74) *Attorney, Agent, or Firm*—Pitney, Hardin, Kipp & Szuch LLP

(57) ABSTRACT

A method of manufacturing a material for a magnesium alloy member, characterized in that the method comprises the steps of: heating a solid-liquid coexistent magnesium alloy up to a temperature in the range of from the solidus temperature or more to the liquidus temperature thereof or less; homogeneously dispersing carbon fibers into the solid-liquid coexistent magnesium alloy, wherein the carbon fibers have been cut into arbitrary lengths or powdered and have not been subjected to surface treatment; and then cooling the magnesium alloy.

11 Claims, 6 Drawing Sheets

PRODUCTION METHOD FOR MAGNESIUM ALLOY MEMBER

TECHNICAL FIELD

The present invention relates to a method of manufacturing a magnesium alloy member, which is a thixotropic material in which a solid material coexists with a liquid material.

BACKGROUND ART

A magnesium alloy member, which is excellent in light weight, high intensity, accuracy and fire retardancy and is a large-scaled thin member, can be enumerated as one of members which constitute the principal portion of a motor vehicle, an aircraft or the like. As technologies for shaping the member, an injection molding method for a thixotropic material, which is disclosed in Japanese Patent KOKOKU No. 33541/89 and Japanese Patent KOKOKU No. 15620/90, is known.

According to this injection molding method, athixotropic material such as a magnesium alloy having a dendrite structure is heated to a temperature in the range of from the liquidus temperature or more to the solidus temperature thereof or less in a molding machine so as to make a solid-liquid coexistent state; and a dendrite is sheared with a screw in the molding machine while the solid-liquid coexistent state is kept, so that the dendrite can be inhibited from growing until the dendrite is injected into a mold.

According to a method of casting a thixotropic material such as a magnesium alloy through an injection molding method, the granulation and growth of a dendrite are inhibited until the dendrite is injected into a mold. However, a thixotropic material such as a magnesium alloy is very high in thermal conductivity, and therefore, after the material is injected into a mold, it is quenched in the mold. This causes a rapid coagulation, which has been the main cause of the following problems.

That is, in the above injection molding method, the dendrite of the thixotropic material in a solid-liquid coexistent state at a temperature in the range of from the liquidus temperature or more to the solidus temperature or less in the mold is sheared and granulated so as to inhibit the growth. However, the thixotropic material exists in a solid-liquid coexistent state before it is injected into the mold, and thus there is a small difference between the temperature of the thixotropic material and the coagulation temperature thereof, which is commonly in the range of from 130° C. to 160° C. Therefore, the thixotropic material as injected into the mold begins to coagulate in a moment of time, whereby the flow pass of the thixotropic material in the mold rapidly becomes narrower. Hence, it is difficult to fill a mold for a thin shaped article, in particular, for a large-scaled complicated thin shaped product such as a motor vehicle with the thixotropic material to the end, and thus it is difficult to improve a large-scaled thin injection molded product in quality. In addition, since the flow pass of the thixotropic material in the mold rapidly becomes narrower, a liquid phase in the thixotropic material, which is easy to flow, escapes to the end of the mold, and/or can contribute to a molding sink, which makes the improvement of a large-scaled thin injection molded article in quality still more difficult.

Against the above-mentioned problems, countermeasures for keeping the temperature of a thixotropic material to the end of a mold have been taken. However, none of them has provided a solution for the above-mentioned problems.

For example, there exists a countermeasure, which comprises increasing the injection speed of a thixotropic material into a mold. That is, this countermeasure is intended to increase the injection speed of the thixotropic material into the mold for a large-scaled thin shaped product to five times or more as compared with the one in a resin injection molding method, or to 35 m/sec or more in some cases, so that the mold can be filled with the thixotropic material to the end in a minute range of temperature decrease. However, when the injection speed of the thixotropic material into the mold has been increased as mentioned above, a mold cavity and/or vortical traces on the surface of an injection molded product are often observed due to turbulence in the flow of the thixotropic material.

As another example, there exists a countermeasure, which comprises applying metal plating or coating of a heat insulating material to the surface of a mold. That is, metal plating or coating of a heat insulating material is applied to the surface over which a thixotropic material in the mold flows so that the heat insulating material can inhibit the temperature of the thixotropic material from decreasing when the thixotropic material is injected thereinto. In this case, the heat insulating material is largely different from a base material of the mold in coefficient of thermal expansion, and therefore, when a material which is heated to a high temperature of 500° C. or more, with which the interior of the mold is filled, is repeatedly cooled in the mold, the plated metal or the coating of the heat insulating material is peeled in earliest stages, and thus the length of life is apt to be shortened. Furthermore, since the injection speed of the thixotropic material is rapid, the surface of the mold is intensely abraded by a solid portion of the thixotropic material, and there by the plated metal or the coating of the heat insulating material is worn away in earliest stages, whereby the life of the mold is further shortened.

Besides, it has been carried out to improve the flowability of a thixotropic material in a mold. For example, a material such as silica or potassium is added to a magnesium alloy so that a solid-phase particle of the magnesium alloy in a semi-molten state becomes minute and spherical so as to improve its flowability. However, with respect to this type of magnesium alloy, the improvement effect of flowability thereof is observed when the magnesium alloy is molded, while the material characteristics of the magnesium alloy member after molding molten, such as strength, cannot be improved.

Accordingly, the material characteristics of the magnesium alloy member after molding are generally inferior to those of an aluminum alloy member, and it has been said that it is difficult to improve the material characteristics thereof. For example, a magnesium-based magnesium alloy is largely weak in tensile strength and fatigue strength as compared with an aluminum-based aluminum alloy. As to tensile strength, the magnesium alloy has its strength of 230 Mpa, while the aluminum alloy has its strength of 315 Mpa. As to fatigue strength, the magnesium alloy has its strength of 70 Mpa, while the aluminum alloy has its strength of 130 Mpa.

Thus, as a countermeasure for increasing the strength of a magnesium alloy, carbon fibers have been used as a reinforcing material for magnesium alloy die-casting. That is, the carbon fibers and the magnesium alloy have been kneaded at a temperature of the solidus temperature or more (about 700° C. or more) so that the magnesium alloy member can be reinforced with the carbon fibers. However, in this case, according to experimental results by the present inventors, as shown in FIG. 6 (which is a graph illustrating the relationship between "the content of $C_3Al_4$ in a carbon fiber" and "the temperature of a molten Al liquid"), when the carbon fiber and the magnesium alloy are kneaded at a temperature of 700° C. or more, an aluminum component in the magnesium alloy reacts with the carbon fiber, whereby the carbon fiber becomes remarkably fragile, and thus it is difficult to improve the strength of a magnesium alloy member with the carbon fiber.

Furthermore, as a means for inhibiting the reaction of an aluminum component in a magnesium alloy with a carbon fiber whereby the carbon fiber is fragile when the magnesium alloy and the carbon fiber are kneaded at a temperature of 700° C. or more, the surface of the carbon fiber is previously treated with metal plating or the like. However, it is difficult to treat the surface of a carbon fiber as described above from the viewpoint of a manufacturing process and capital investment, whereby the manufacturing cost of a magnesium alloy member becomes considerably high.

In addition, a material for a magnesium alloy member, the material being used for the present injection molding machine, is commonly in the shape of a chip, which is obtained by cutting an ingot of the magnesium alloy. In this chip-shaped material for the magnesium alloy member, when the ingot is cut, a cut powder, which is easy to ignite, arises therefrom, whereby the yielding percentage of the material may be decreased. Furthermore, in order to prevent a molten magnesium alloy in a mold from igniting, it is necessary to contrive cutting air off in a material hopper, which is freely imported together with the chip-shaped magnesium alloy material. However, this contrivance is difficult, in particular, when the member is continuously produced on a large scale, a lot of difficulty is involved.

For example, a manner of feeding a chip-shaped material for the magnesium alloy member into the material hopper (which is hereinafter referred to as "hopper") of the above injection-molding machine, and the problem thereabout to be solved will be explained.

A common feeding manner is the one in which the chip-shaped material for the magnesium alloy member (which is hereinafter referred to as "chip material") can be directly fed from a pouched device into the hopper. This feeding manner comprises the operation steps of: opening and closing the lid of the hopper while checking out the operations; and filling the interior of the hopper with an inert gas such as argon gas after closing the hopper. Thus it is very difficult to automate the operation steps.

Furthermore, another manner for feeding the chip material into the hopper is the one in which a system, as shown in FIG. 7, is used. This feeding manner is the one in which the chip material is continuously fed into a hopper (85) through a duct (83) with an air blower (81) from a material silo (82). In this manner, air is freely and continuously imported into the hopper (85), together with the chip material. Therefore, when the chip material is discharged into a barrel (84) of an injection-molding machine (87), a molten magnesium alloy is in danger of igniting, and thus it is necessary to shut off the interior of the hopper (85) from the air. Thus it is necessary to feed a lot of argon gas into the hopper (85) from an argon gas tank (86), or to make various complicated mechanical contrivances so as to prevent air from irrupting into the hopper (85). Consequently, the cost of facilities is increased.

DISCLOSURE OF THE INVENTION

Accordingly, a first object to be solved according to the present invention is to provide a method of manufacturing a magnesium alloy member, by which the shaping of a thin injection-molded member or the like for a motor vehicle or the like is facilitated, and the improvement of intensities thereof is facilitated, and furthermore the implementation thereof can be advantageously carried out in terms of capital investment.

According to the present invention, a magnesium alloy in which a carbon fiber is homogeneously dispersed is heated to a temperature in the range of from the solidus temperature or more to the liquidus temperature or less so as to obtain a solid-liquid coexistent magnesium alloy, wherein the carbon fiber has been cut into arbitrary lengths or powdered and has not been subjected to surface treatment; the above carbon fiber is homogeneously dispersed in the above solid-liquid coexistent magnesium alloy by a dispersion means so as to obtain a carbon fiber dispersed magnesium alloy; and then the above carbon fiber dispersed magnesium alloy is molded by means of a cylinder injection method or a die-casting method.

In addition, in the present invention, a series of the above operations is carried out in one selected from the group consisting of an inert atmosphere, a closed atmosphere, and a closed inert atmosphere. By manufacturing the magnesium alloy member in such a manner, it can be protected from deteriorating in quality due to oxidation.

Furthermore, in the present invention, the above solid-liquid coexistent magnesium alloy is dispersed by at least one means selected from the group consisting of agitation, subsonic vibration, shock wave vibration, and agitating vibration.

Besides, in the present invention, a magnesium alloy in which the content of the above carbon fiber is in the range of from 1 to 20% by weight, and the content of aluminum is 10% by weight or less is used as the above magnesium alloy.

According to the present invention as mentioned above, various operations and/or working-effects will be provided owing to the following technical reasons.

That is, as shown in FIG. 6 with respect to experimental results, the carbon fiber whose surface is not treated hardly reacts with an aluminum component at a temperature of 650° C. or less at which the magnesium alloy is in a solid-liquid coexistent state, and thus even when the carbon fiber whose surface is not treated and the magnesium alloy are kneaded at a temperature of 650° C. or less, the carbon fiber does not become fragile, and the strength of the carbon fiber is maintained, and the strength of the magnesium alloy member is drastically increased.

Furthermore, wetting properties of the carbon fiber whose surface is not treated to the magnesium alloy which is in a solid-liquid coexistent state are thoroughly suppressed because the surface of the carbon fiber is not treated, so that the carbon fiber can act as a barrier between molecules of the magnesium alloy which intensely move. Resultantly, the carbon fiber whose surface is not treated acts as a factor, which inhibits transmission of thermal energy in the magnesium alloy which is in a solid-liquid coexistent state, as well as a factor which inhibits the growth of a dendrite of the magnesium alloy because the carbon fiber has no wetting properties. Owing to these actions, the growth of a dendrite which is the largest problem to be solved in an injection molding method of a magnesium alloy which is in a solid-liquid coexistent state is retarded, and at the same time a rapid coagulation speed of the magnesium alloy in a mold is remarkably decreased.

Besides, as experimental data, Table 1 shows the tensile strength and the liquidity ratio of each of AZ91D which is one of conventional magnesium alloy members; a carbon fiber reinforced magnesium alloy member which is reinforced with a carbon fiber, which corresponds to a shaped product of the present invention; and a conventional aluminum alloy member.

TABLE 1

| | AZ91D | Carbon Fiber Magnesium Alloy | Aluminum Alloy 380 |
|---|---|---|---|
| Tensile Strength | 230 MPa | 365.4 Mpa | 315 MPa |
| Liquidity Ratio (Inflow Length Ratio) | 106 | 190 | 100 |

Base Material: Magnesium Alloy AZ91D
Composite Material: Carbon Fiber Whose Surface Is Not Treated
Type of Carbon Fiber: PAN System, Pitch System, Synthetic polymer System
Length of Carbon Fiber: 0.05 mm, 0.1 mm, 0.5 mm, 1 mm, 2 mm, 3 mm
Content of Carbon Fiber in Base Material: 15%

Incidentally, liquidity ratios as shown in Table 1 were determined by comparing the inflow length of a material of the present invention and that of AZ91D, when each of the materials of the present invention and AZ91D was heated to an identical temperature in the range of from the liquidus temperature or more to the solidus temperature or less, and the material of the present invention was injected into a narrow and long tunnel through a injection molding machine, wherein the tunnel had had a temperature of 20° C. and had been made of a mass of iron.

As can be apparently taken from Table 1, a carbon fiber magnesium alloy as reinforced with a carbon fiber whose surface is not treated may be delayed in growth of dendrite, and thus the fluidity is remarkably improved when the magnesium alloy is in a solid-liquid coexistent state. Resultantly, it is easy to fill the magnesium alloy to the end of a mold for a thin complicated shaped product without increasing an injection speed on molding to a large extent. Furthermore, it is unnecessary to largely increase a discharge pressure for increasing the injection speed, and thereby the leakage of the material from a gap of the mold is decreased, and thus it is easy to carry out secondary processing such as deburring after molding. Thereby, it is easy to manufacture a thin shaped product; in particular, it is easy to manufacture a large-scaled complicated thin shaped product, which has been conventionally considered to be difficult. With respect to a large-scaled thin shaped product, a shrinkage hole, an eddy vestige, a mold cavity or the like is inhibited from occurring. Thus the quality of a shaped product is remarkably improved.

Besides, as shown in Table 1, the carbon fiber magnesium alloy is remarkably increased in strength. This is because the carbon fiber was strongly fixed in the base material owing to an anchoring effect by which the base material of the magnesium alloy physically bites the surface of the carbon fiber that is not fragile.

In addition, as can be taken from Table 1, the magnesium alloy which is in a solid-liquid coexistent state hardly reacts with the carbon fiber, and thus surface treatment of a carbon fiber or precasting of a carbon fiber, which has been conventionally carried out in order to protect the carbon fiber from becoming fragile, is unnecessary. Furthermore, measures for elevating the temperature of a mold, coating of a heat-insulating material over the surface of a mold, or metal plating is unnecessary, and thus the drastically low cost of a mold and a mold with a long life can be realized.

Operations and/or working-effects owing to a carbon fiber whose surface is not treated as mentioned above depend upon the amount of the carbon fiber to a magnesium alloy, and the quality of material of the magnesium alloy itself. It is when a magnesium alloy has a carbon fiber content in the range of from 1% to 20% by weight ratio, and an aluminum content of 10% by weight ratio or less that the operations and/or working-effects as mentioned above are manifested; namely, when the content of the carbon fiber is less than 1% by weight ratio, the working-effects are small, while when the content is more than 20% by weight ratio, the quality of material of a magnesium alloy is deteriorated.

Besides, in the present invention, the shape of a material of a magnesium alloy member is intended to be in such one in which a wire or thin sheet shaped material is wound in the shape of a roll. It is effective for simplifying the steps of manufacturing a magnesium alloy member of the present invention, and for lowering the cost of a material for a magnesium alloy member that the shape of the material is specified. Furthermore, it is also effective for implementing the shutoff of air, which is most dangerous for the above material, when the material is fed into a hopper of an injection-molding machine, so that the shutoff can be advantageous from a viewpoint of capital investment.

BEST MODE FOR CARRYING OUT THE INVENTION

Figure 1:
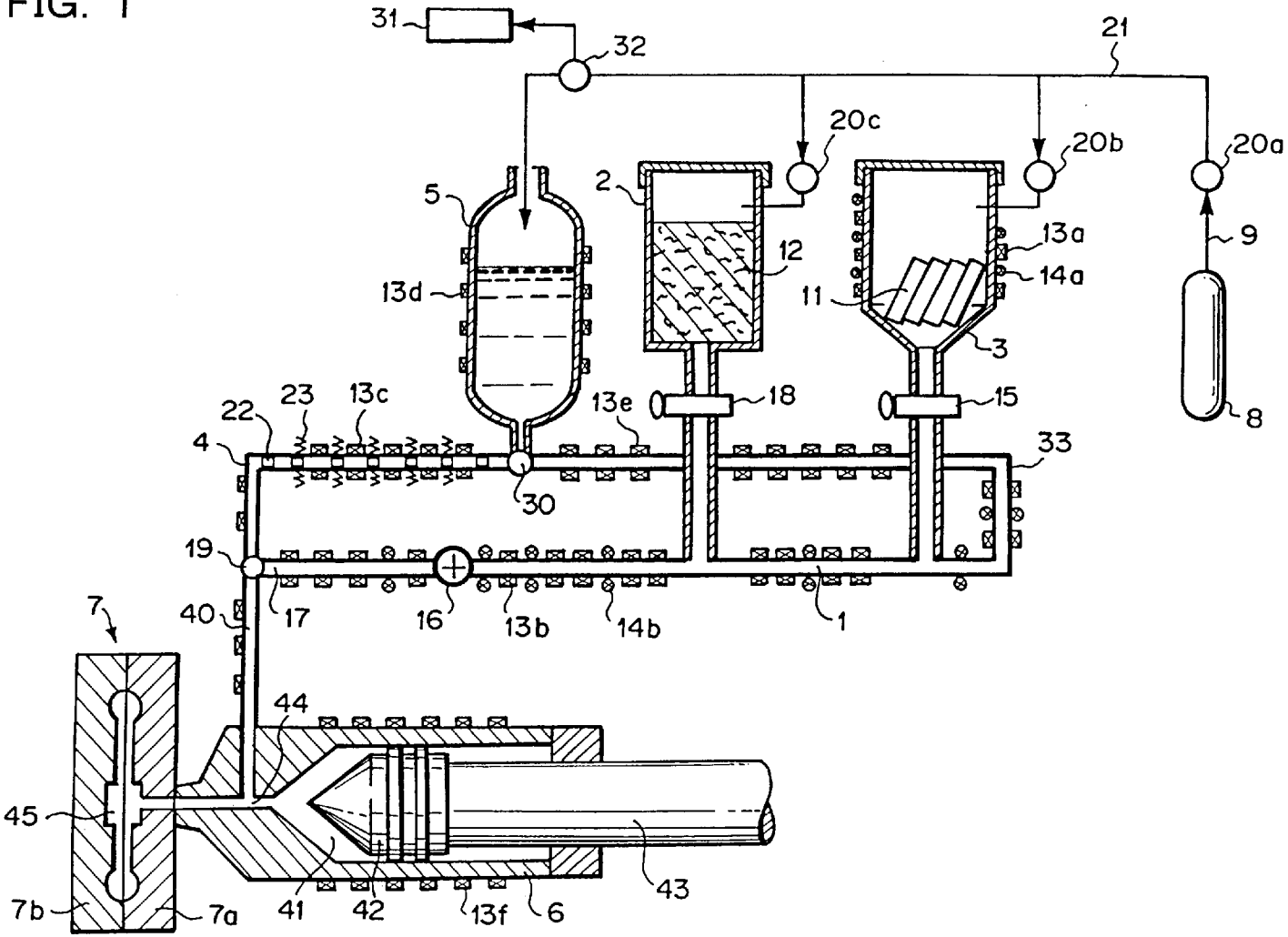
FIG. 1 is a diagram illustrating a manufacturing process of a magnesium alloy member of the present invention.

A first example of a process according to the present invention will be described as follows:

the first step: of heating a magnesium alloy into a solid-liquid coexistent state at a temperature in the range of from the solidus temperature or more to the liquidus temperature or less by using a heater or the like in such an atmosphere as can protect the magnesium alloy from oxidation, for example, in an inert gas;

the second step: of weighing a carbon fiber which has not been subjected to surface treatment and has been cut into short lengths, and adding a proper amount (for example, from 1 to 20% by weight) of the carbon fiber to the magnesium alloy;

the third step: of heating the magnesium alloy and the carbon fiber which has not been subjected to surface treatment and is cut into short lengths to a temperature in the range of from the solidus temperature or more to the liquidus temperature or less while kneading the same, wherein the carbon fiber is hereinafter referred to as "the carbon fiber";

the forth step: of homogeneously dispersing the carbon fiber into the first magnesium alloy by means of one selected from the group consisting of agitation, subsonic vibration, shock wave vibration, and agitating vibration, while heating the same to a temperature in the range of from the solidus temperature or more to the liquidus temperature or less;

the fifth step: of , if necessary, repeating the second step, the third step and the forth step in order to satisfactorily disperse the carbon fiber; and the sixth step: of injecting the resulting magnesium alloy with the carbon fiber, as described above, into a mold with an injection cylinder, while keeping the temperature in the range of from the solidus temperature or more to the liquidus temperature or less.

All the steps as described above are carried out in an atmosphere of an inert gas such as argon gas so as to protect the magnesium alloys from oxidation.

A second example of a process according to the present invention will be described as follows, wherein the following steps can be divided into the steps of manufacturing a wire rod or a thin sheet material of a magnesium alloy and the steps of cylinder injection with the rod or material:

the first step: of heating a magnesium alloy to a solid-liquid coexistent state at a temperature in the range of from the solidus temperature or more to the liquidus temperature or less by using a heater or the like in such an atmosphere as can protect the magnesium alloy from oxidation, for example, in an inert gas or in a sealing state;

the second step: of weighing a carbon fiber which has not been subjected to surface treatment and has been cut into short lengths, and adding a proper amount (for example, from 1 to 20% by weight) of the carbon to the magnesium alloy, wherein the carbon fiber is hereinafter referred to as "the carbon fiber";

the third step: of heating the magnesium alloy and the carbon fiber to a temperature in the range of from the solidus temperature or more to the liquidus temperature or less, so as to satisfactorily knead the same;

the forth step: of homogeneously dispersing the carbon fiber into the magnesium alloy by means of one selected from the group consisting of agitation, subsonic vibration, shock wave vibration, and agitating vibration, while heating the same to a temperature in the range of from the solidus temperature or more to the liquidus temperature or less, so as to provide a carbon fiber magnesium alloy;

the fifth step: of, if necessary, repeating the second step, the third step and the forth step in order to satisfactorily disperse the carbon fiber;

the sixth step: of discharging the resulting carbon fiber agnesium alloy, which has been controlled to a solid-liquid coexistent state at a proper temperature, into a satisfactorily cooled liquid which is inert to the magnesium alloy, from a discharge opening, wherein the carbon fiber magnesium alloy is quenched by making contact with the satisfactorily cooled liquid, and solidified to the shape of a wire or a thin sheet, and thereafter is kept at a temperature at which plastic working can be easily carried out, and is rolled with a roller or the like so as to be wound in a roll shape; and the seventh step: of feeding a material of the carbon fiber magnesium alloy in the shape of a wire or a thin sheet from a roll thereof into a material-preheating section of a molding machine, and elevating the material therein to a proper temperature of the liquidus temperature or less, so that the carbon fiber magnesium alloy which has been liquefied in the material-preheating section can be introduced into a barrel of the molding machine, wherein the carbon fiber magnesium alloy in the barrel is fed into the mold from a discharge port through a material-storage chamber while being kept at a temperature in the range of from the solidus temperature or more to the liquidus temperature or less.

All the steps as described above are carried out in an atmosphere of an inert gas such as argon gas.

Next, an example of a system for carrying out a method of the present invention will be explained.

FIG. 1 shows a system for manufacturing a magnesium alloy member of the present invention. This system is one example of a system for manufacturing a material obtained by kneading a base material of a magnesium alloy and a carbon fiber which has not been subjected to surface treatment, in an inert atmosphere of argon gas so as to provide a shaped product of a magnesium alloy member, wherein a carbon fiber hopper (2), a magnesium alloy material hopper (3), and a material dispersion piping (for example, a subsonic dispersion piping (4)) are connected to a horizontal kneading apparatus (1) which can satisfactorily knead the carbon fiber and a heated and molten magnesium alloy, wherein an intermediate storage tank (5) is connected to the outlet of the subsonic dispersion piping (4), and an injection cylinder (6) is connected to the inlet of the subsonic dispersion piping (4), wherein a mold (7) is connected to the end of the injection cylinder (6). Argon gas (9) is fed into each of the hoppers (2 and 3) and into the intermediate storage tank (5) from a gas bomb (8). Hereinafter, the constitution of each constituent part will be explained according to each manufacturing operation of the magnesium alloy member.

An ingot (11) of a magnesium alloy is introduced into the material hopper (3), and then argon gas (9) is fed into the material hopper (3) which has been closed, through a valve (20*a*), a gas supply pipe (21) and a valve (20*b*) from the gas bomb (8). The interior of the material hopper (3) is filled with this argon gas (9) so that the argon gas (9) can protect the molten magnesium alloy resulting from the ingot (11) from rapid oxidation. The ingot (11) is heated to a temperature of the solidus temperature or more using a band heater (13*a*) and a heating induction coil (14*a*), which are fixed on the periphery of the material hopper (3), and then the molten magnesium alloy is fed into the kneading apparatus (1) through a material weighing device (15). In the kneading apparatus (1), the magnesium alloy as fed from the material weighing device (15) is fed to a discharge opening (17) of the kneading apparatus with a kneading pump (16).

On the other hand, a carbon fiber (12) is fed into the carbon fiber hopper (2) wherein the carbon fiber (12) has not been subjected to surface treatment, and has been cut into short lengths, and then the interior of the closed hopper (2) is filled with argon gas (9) through the gas supply pipe (21) and a valve (20*c*). The carbon fiber (12) in the carbon fiber hopper (2) is introduced into the kneading apparatus (1) through a carbon fiber weighing device (18), and fed to the discharge opening (17) by means of the kneading pump (16).

The magnesium alloy and the carbon fiber in the kneading apparatus (1) are maintained at a temperature in the range of from the solidus temperature of the magnesium alloy or more to the liquidus temperature thereof or less using a band heater (13*b*) and a heating induction coil (14*b*) which are fixed on the exterior surface of the kneading apparatus (1). The magnesium alloy and the carbon fiber are introduced to the discharge opening (17) using the pump (16) to satisfactorily knead.

Incidentally, the kneading apparatus (1) and the pump (16), which are operated as mentioned above, can be interchanged with a rotary pump, a screw pump or the like which has been heated to a temperature in the range of from the solidus temperature or more to the liquidus temperature or less using a band heater, a heating induction coil or the like, which is not shown in any Figure.

The magnesium alloy and the carbon fiber which have been extruded to the discharge opening (17) using the pump (16) are introduced into the subsonic dispersion piping (4) through a change valve (19), and then they are dispersed so that the carbon fiber can be homogeneously dispersed into the magnesium alloy. On the exterior surface of the subsonic dispersion piping (4), a band heater (13*c*), a subsonic vibrator (22) and a low frequency generating coil (23) are positioned. The interior of the subsonic dispersion piping (4) is heated using the band heater (13*c*) or the like so as to control the temperature of the magnesium alloy which has been kneaded with the carbon fiber to a temperature in the range of from the solidus temperature or more to the liquidus temperature or less. The low frequency generating coil (23) vibrates the subsonic vibrator (22) at a subsonic vibration so that the magnesium alloy, which has been kneaded with the carbon fiber, can vibrate at a subsonic vibration so as to disperse the carbon fiber. Then, the frequency of the subsonic vibrator (22) is preferred to be 1 kHz or less. The magnesium alloy into which the carbon fiber has been dispersed using the subsonic vibrator (22) as mentioned above will be referred to as "a carbon fiber dispersion magnesium alloy", if necessary.

Figure 2:
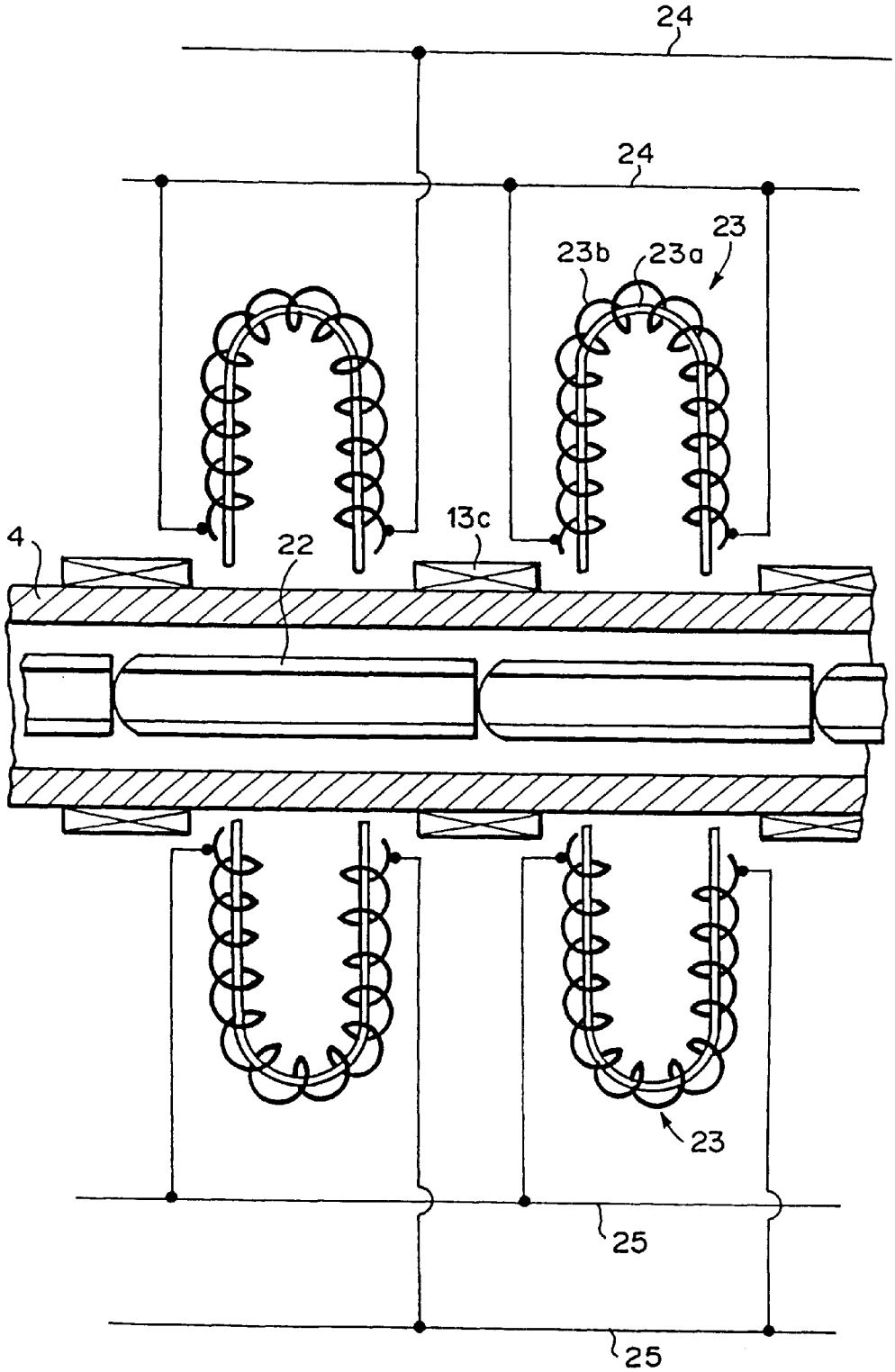
FIG. 2 is an enlarged view of the section of low frequency dispersion in FIG. 1.

Incidentally, a magnetic metal, or a magnetic metal whose surface is coated with ceramics or the like or plated can be used as the subsonic vibrator (22). A ceramics piping can be used as the subsonic dispersion piping (4). A plurality of the subsonic vibrators (22) is continuously arranged in the carbon fiber dispersion piping (4). A plurality of the low frequency-generating coils (23) is continuously arranged on the periphery of the subsonic dispersion piping (4) while corresponding to the plurality of the subsonic vibrator (22). As shown in FIG. 2, the low frequency generating coil (23) is a device in which an insulated wire (23*b*) is wound in the shape of a coil around an iron core of a silicon-steel plate 23*a*), wherein a low frequency current which is synchronized sing wires (24, 25) is passed through each of the plurality of low frequency generating coils (23).

The carbon-fiber dispersion magnesium alloy in the subsonic dispersion piping (4) is fed into the intermediate storage tank (5) through a change valve (30), wherein the carbon-fiber dispersion magnesium alloy is stored as a carbon-fiber dispersion magnesium alloy molten liquid. The temperature of the magnesium alloy in the intermediate storage tank (5) is controlled within the range of from the solidus temperature or more to the liquidus temperature or less using a band heater (13*d*) which is fixed on the exterior surface of the intermediate storage tank (5). The interior of the intermediate storage tank (5) is filled with argon gas (9) from the gas bomb (8). Furthermore, if necessary, a vacuum pump (31) is fixed on the upper side of the intermediate storage tank (5), and a gas in the intermediate storage tank (5) is discharged through a valve (32) using the vacuum pump (31) so that the carbon-fiber dispersion magnesium alloy molten liquid can be degassed. This degassing is carried out in a state in which the intermediate storage tank (5) is shut off from the subsonic dispersion piping (4) using the change valve (30).

When the magnesium alloy in an amount sufficient for injection molding is stored in the intermediate storage tank (5), the feedings of the carbon fiber and the magnesium alloy into the kneading apparatus (1) are stopped. Thereafter, the carbon-fiber dispersion magnesium alloy molten liquid in the intermediate storage tank (5) is discharged into a recovery and supply piping (33) through the change control valve (30). This discharging of this molten liquid is carried out under a pressure of argon gas as supplied into the intermediate storage tank (5). The temperature of the carbon-fiber dispersion magnesium alloy molten liquid as discharged into the recovery and supply piping (33) is controlled within the range of from the solidus temperature or more to the liquidus temperature or less using a band heater (13*e*), which is fixed on the recovery and supply piping (33), and the molten liquid is recovered in the kneading apparatus (1).

The carbon-fiber dispersion magnesium alloy as recovered in the kneading apparatus (1) is fed to the discharge opening (17) using the pump (16), and introduced into the subsonic dispersion piping (4) through the change valve (19). A series of operations as described above is repeated until the carbon fiber is satisfactorily dispersed into the magnesium alloy by agitation and an amount of the carbon-fiber dispersion magnesium alloy with which casting can be carried out one time can be ensured.

After an amount of the carbon-fiber dispersion magnesium alloy with which casting can be carried out one time has been ensured, the change valve (19) located at the discharge opening (17) is changed so that the carbon-fiber dispersion magnesium alloy can be delivered into a material storage chamber (41) in the injection cylinder (6) through a material supply piping (40) from the discharge opening (17). According to this delivery, a plunger (42) in the injection cylinder (6) is backed out with an injection ram (43) so that the material storage chamber (41) can be filled with the carbon-fiber dispersion magnesium alloy. The carbon-fiber dispersion magnesium alloy with which the material storage chamber (41) has been filled is kept at a temperature in the range of from the solidus temperature or more to the liquidus temperature or less using a band heater (13*f*) or the like which is fixed on the injection cylinder (6).

After the material storage chamber (41) has been satisfactorily filled with the carbon-fiber dispersion magnesium alloy, the injection ram (43) is advanced so that the carbon-fiber dispersion magnesium alloy can be extruded into the mold (7) from a nozzle (44) by the plunger (42). The mold (7) comprises a fixed mold (7*a*) and a movable mold (7*b*), wherein a mold chamber (45) between the fixed mold (7*a*) and the movable mold (7*b*) is filled with the carbon-fiber dispersion magnesium alloy from the side of the fixed mold (7*a*). After the carbon-fiber dispersion magnesium alloy with which the mold chamber (45) was filled has been coagulated, the movable mold (7*b*) is mold-opened so that the carbon-fiber dispersion magnesium alloy can be removed therefrom as a shaped product.

The manufacture of the magnesium alloy member as described above can be continuously repeated using the system for manufacturing the same.

Incidentally, in the manufacturing system as shown in FIG. 1, the dispersion of the carbon fiber in the magnesium alloy is intended to proceed at a low frequency. However, this type of dispersion may be carried out through agitating with an agitating blade, or through impacting with a shock wave such as a sound wave.

Figure 3:
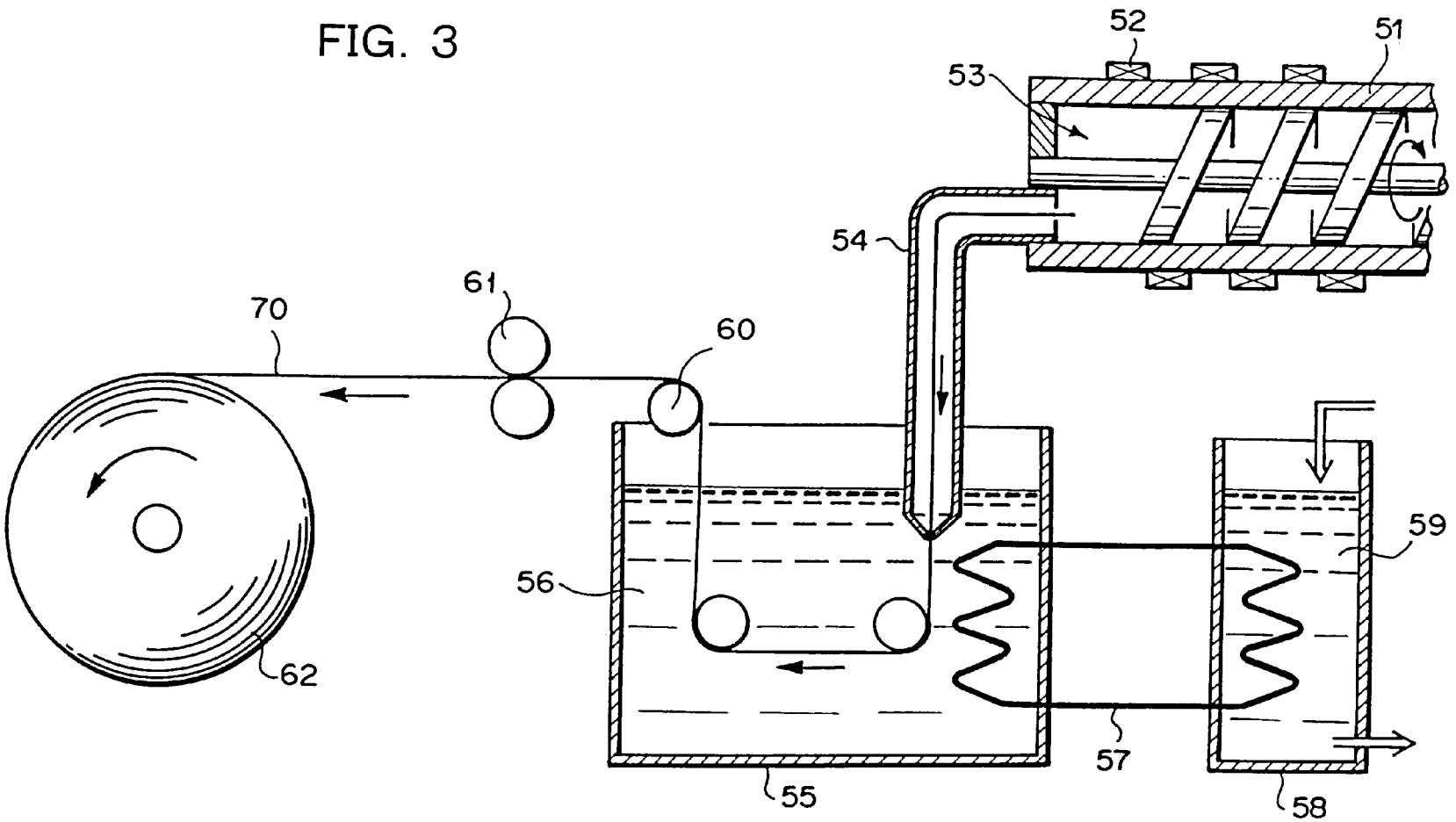
FIG. 3 is a diagram illustrating a manufacturing process of a material for a magnesium alloy member of the present invention.
Figure 4:
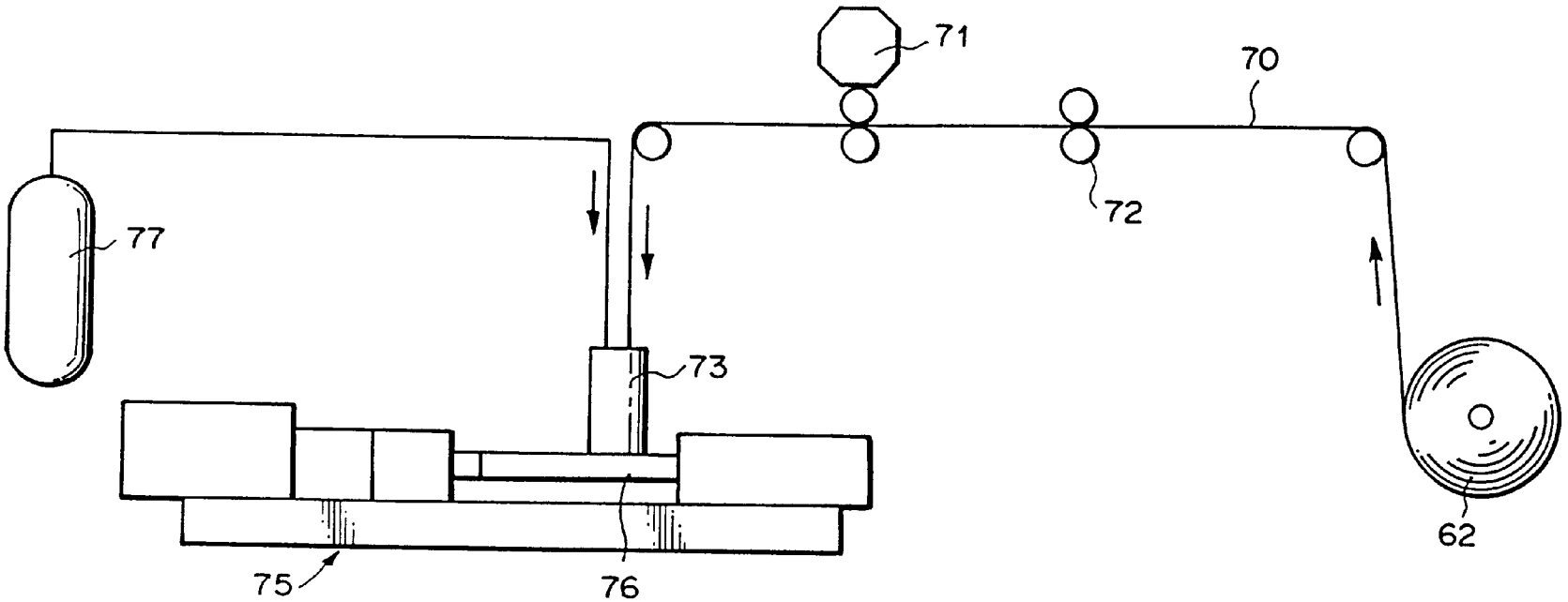
FIG. 4 is a diagram illustrating a manufacturing process of the magnesium alloy member using the material as manufactured according to FIG. 3.
Figure 5:
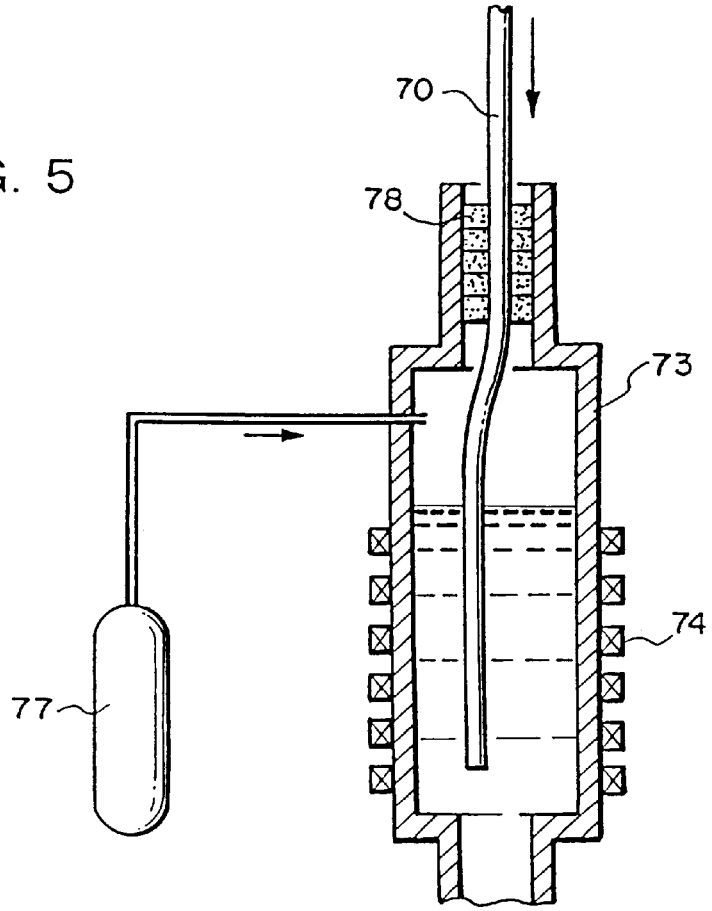
FIG. 5 is an enlarged view of the section of preheating the material in FIG. 4.
Figure 6:
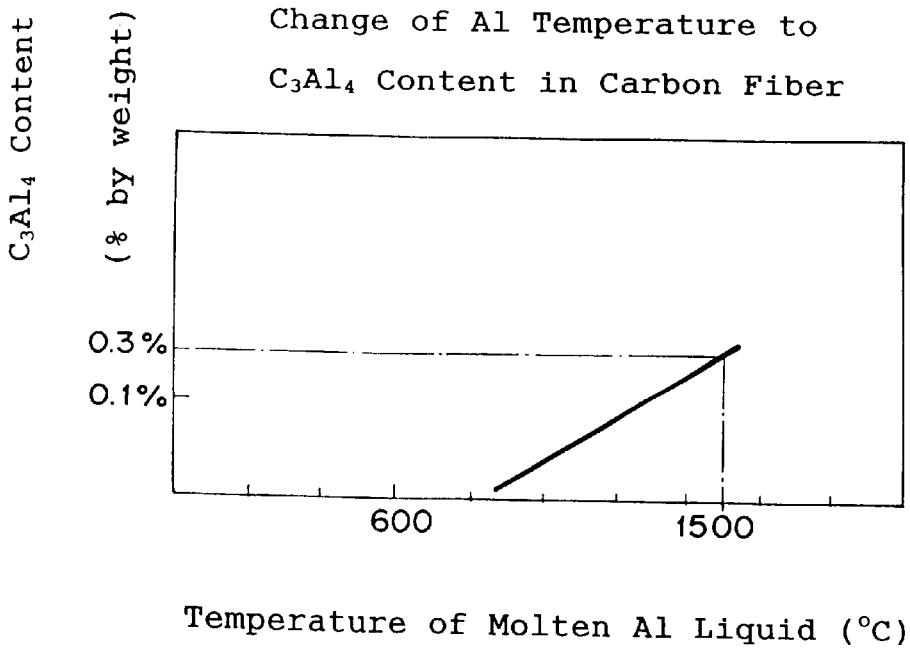
FIG. 6 is a graph illustrating the relationship between "the content of Al in a carbon fiber" and "the temperature of a molten Al liquid"
Figure 7:
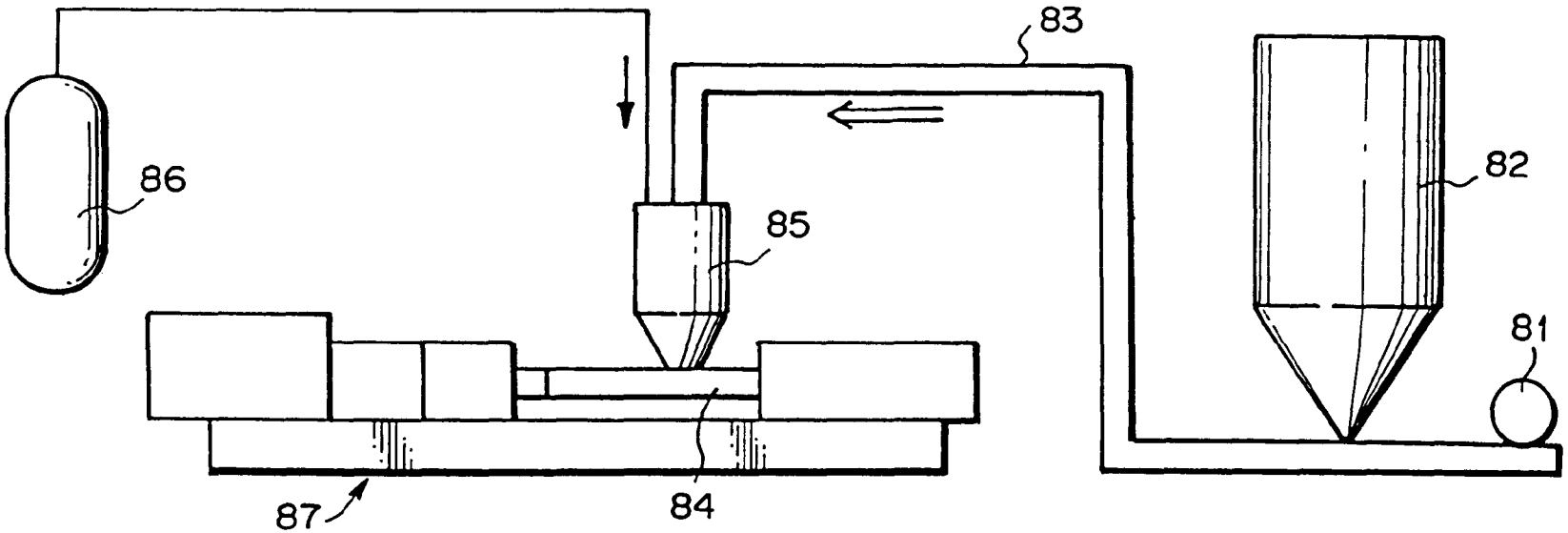
FIG. 7 is a diagram illustrating a facility for feeding a chip-like material into a material hopper for an injection-molding machine according to a conventional method.

Next, working examples for other systems with respect to the present invention will be shown in FIGS. 3 to 5 for explanation.

First of all, in FIG. 3, a carbon-fiber dispersion magnesium alloy in which a carbon fiber is satisfactorily dispersed in the same manner as the example of FIG. 1 is discharged into a first cooling liquid (56) in a first cooling bath (55) through a nozzle (54) by means of a feeder (53) from a barrel (51) in which the magnesium alloy is kept at a temperature in the range of from the solidus temperature or more to the liquidus temperature or less using a band heater (52) or the like, wherein the carbon-fiber dispersion magnesium alloy is quenched into a wire rod or a thin sheet material. As the first cooling liquid (56), in this case, a batch of oil such as silicone oil, which is inert to magnesium, is selected. The first cooling liquid (56) is cooled by a flow of cooling liquid through a cooling liquid circulation piping (57) so that the temperature can be kept constant. The cooling liquid in the cooling liquid circulation piping (57) is introduced into a second cooling bath (58), and cooled with cooling water (59) in the second cooling bath (58). The water supply of the cooling water (59) into the second cooling bath (58) and the drainage thereof out of the second cooling bath (58) are simultaneously carried out.

A wire rod or a thin sheet material of the carbon-fiber dispersion magnesium alloy, which has been produced in the first cooling bath (55), is introduced to a pulley (60), shaped through a roller (61), and wound into the form of a roll (62). The wire rod (70) of the carbon-fiber dispersion magnesium alloy as wound into the form of the roll (62) is fed into a molding machine according to a method in which facilities as shown in FIG. 4 are used.

The wire rod (70) of the carbon-fiber dispersion magnesium alloy from the roll (62) is introduced into a material preheating section (73) through a pulley (72) by a pulley driving motor (71). The material preheating section (73) will be illustrated as follows. The wire rod (70) of the carbon-fiber magnesium alloy is fed into a barrel (76) of a molding machine (75) while being heated to a temperature in the range of from the solidus temperature or more to the liquidus temperature or less using a band heater (74) or a heating induction coil (not shown), wherein the interior space of the preheating section (73) is filled with argon gas as fed from an argon gas tank (77), and the wire rod (70) of the carbon-fiber magnesium alloy is fed into the material preheating section (73) through a sealing section (78) by which an air inflow into the interior of the material preheating section (73) is inhibited to the minimum.

INDUSTRIAL APPLICABILITY

As explained above, according to the present invention, a carbon fiber whose surface is not treated exists in a magnesium alloy which is in a solid-liquid coexistent state, wherein the carbon fiber acts as a barrier between molecules and/or as a factor by which the transmission of heat energy is inhibited, and thereby the growth of the magnesium alloy into a dendrite is inhibited, and therefore, the rate of rapid solidification of the magnesium alloy is retarded in a mold according to a cylinder injection method or a die-casting method so that an infilling to the end of a mold for a complicated thin molded product can be advantageously carried, in particular, the manufacture and quality improvement of a magnesium alloy molded product in the shape of a large-scaled complicated thin molded product can be easily attained. Furthermore, high-temperature treatment for a mold temperature, thermal insulation treatment for the surface of the mold, and the like which have been conventionally carried out are unnecessary owing to a retardation in the rate of rapid solidification of the magnesium alloy in a mold according to a cylinder injection method or a die-casting method, whereby the cost of the mold can be lowered, and the life of the mold can be extended.

Besides, the strength of a magnesium alloy base material can be easily increased because the magnesium alloy base material is adhered to the carbon fiber whose surface is not treated, whereby a magnesium alloy member which is suitable as a light-weight, high-strength, precise, flame-retardant and large-scaled thin member can be provided.

In addition, owing to the use of a wire rod or a thin sheet material of the carbon-fiber dispersion magnesium alloy, a continuous blocking of air can be relatively easily carried out at a material feeding section of a molding machine, whereby magnesium alloy products can be manufactured on a large scale. Furthermore, an apparatus for automatically feeding a material into a molding machine is easily provided, and thereby the cost of facilities can be cut down. Besides, a material can be directly manufactured from the step of dispersing the carbon fiber into the magnesium alloy, and therefore, the step of cutting in a process of manufacturing a chip material can be omitted, and there occurs no dust in the process of manufacturing a chip material, whereby the yield rate of the material is improved, and the cost of the material can be lowered.

What is claimed is:

1. A method of manufacturing a material for a magnesium alloy member, characterized in that the method comprises the steps of:

heating a solid-liquid coexistent magnesium alloy up to a temperature in the range of from the solidus temperature or more to the liquidus temperature thereof or less;

homogeneously dispersing carbon fibers into said solid-liquid coexistent magnesium alloy, wherein said carbon fibers have been cut into arbitrary lengths or powdered and have not been subjected to surface treatment; and then cooling said magnesium alloy.

2. A method of manufacturing a material for a magnesium alloy member according to claim 1 wherein said steps are carried out in an atmosphere selected from the group consisting of an inert atmosphere, a closed atmosphere, and a closed inert atmosphere.

3. A method of manufacturing a material for a magnesium alloy member according to claim 1 wherein said steps are carried out in an argon gas atmosphere.

4. A method of manufacturing a material for a magnesium alloy member according to any one of claims 1 to 3, characterized in that said magnesium alloy which is in a solid-liquid coexistent state is homogeneously dispersed by means of one selected from the group consisting of agitation, subsonic vibration, shock wave vibration, and agitating vibration.

5. A material for a magnesium alloy member, said material resulting from a magnesium alloy which is in the shape of a wire or thin sheet wound in the shape of a roll and provided according to a method of claim 1, and wherein the content of said carbon fiber is in the range of from 1 to 20% by weight, and the magnesium alloy comprises aluminum in the amount of 10% by weight or less.

6. A method of manufacturing a magnesium alloy member, characterized in that said method comprises the steps of:

heating a magnesium alloy in which carbon fibers are homogeneously dispersed to a temperature in the range of from the solidus temperature or more to the liquidus temperature or less so as to obtain a solid-liquid coexistent magnesium alloy, wherein said carbon fibers have been cut into arbitrary lengths or powdered and have not been subjected to surface treatment;

homogeneously dispersing said carbon fibers in said solid-liquid coexistent magnesium alloy by a dispersion means so as to obtain a carbon fiber dispersed magnesium alloy; and molding said carbon fiber dispersed magnesium alloy by means of a cylinder injection method or a die-casting method.

7. A method of manufacturing a magnesium alloy member according to claim 6, characterized in that said steps are carried out in one atmosphere selected from the group consisting of an inert atmosphere, a closed atmosphere, and a closed inert atmosphere.

8. A method of manufacturing a magnesium alloy member according to claim 6, characterized in that said steps are carried out in an argon gas atmosphere.

9. A method of manufacturing a magnesium alloy member according to any one of claims 6 to 8, characterized in that said dispersion means is one selected from the group consisting of agitation, subsonic vibration, shock wave vibration, and agitating vibration.

10. A method of manufacturing a magnesium alloy member according to any one of claims 6 to 8, wherein the alloy comprises carbon fibers is in the range present in the amount of from 1 to 20% by weight, and aluminum in the amount of 10% by weight or less.

11. A method of manufacturing a magnesium alloy member according to any one of claims 6 to 8, characterized in that a material for a magnesium alloy member according to claim 1 is run out from a state of roll for use as said magnesium alloy.

* * * * *